United States Patent [19]

Urani et al.

[11] Patent Number: 4,720,695

[45] Date of Patent: Jan. 19, 1988

[54] CARTRIDGE FUSE CONSTRUCTION AND ASSEMBLY

[75] Inventors: Angelo Urani, Ellisville; Aldino Gaia, St. Louis, both of Mo.

[73] Assignee: Cooper Industries, Inc., Houston, Tex.

[21] Appl. No.: 20,170

[22] Filed: Feb. 27, 1987

Related U.S. Application Data

[63] Continuation of Ser. No. 725,769, Apr. 22, 1985, abandoned.

[51] Int. Cl.[4] ..... H01H 85/16

[52] U.S. Cl. ..... 337/254; 337/252; 337/232

[58] Field of Search ..... 337/254, 253, 252, 251, 337/248, 236, 232, 228, 227, 231

[56] References Cited

U.S. PATENT DOCUMENTS

| | | | |
|---|---|---|---|
| 975,261 | 11/1910 | Leveen et al. | 337/231 |
| 1,304,024 | 5/1919 | Cook | 337/251 |
| 2,864,916 | 12/1958 | Barrett et al. | 337/252 |

FOREIGN PATENT DOCUMENTS

| | | | |
|---|---|---|---|
| 135406 | 10/1902 | Fed. Rep. of Germany | 337/251 |
| 956137 | 4/1964 | United Kingdom | 337/251 |

*Primary Examiner*—H. Broome

*Attorney, Agent, or Firm*—Eddie E. Scott; Nelson A. Blish; Alan R. Thiele

[57] ABSTRACT

A cartridge fuse including a tubular insulating body, integrally formed ferrule terminals secured over the respective ends of the insulating body, and a fusible strip extending within the insulating body electrically interconnecting the ferrule terminals.

4 Claims, 7 Drawing Figures

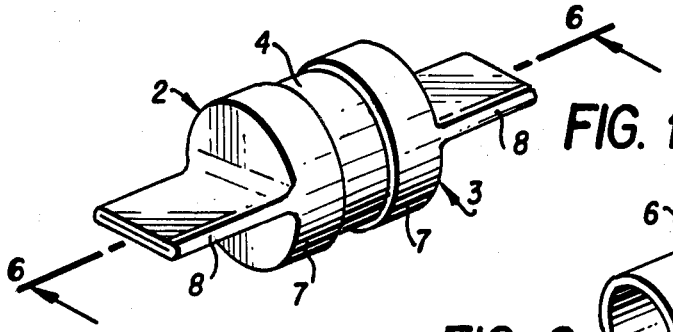
FIG. 1
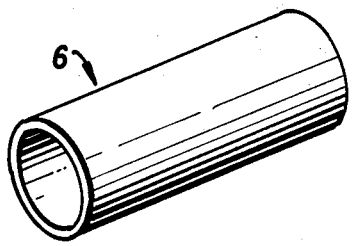
FIG. 2
FIG. 3
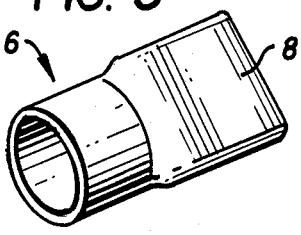
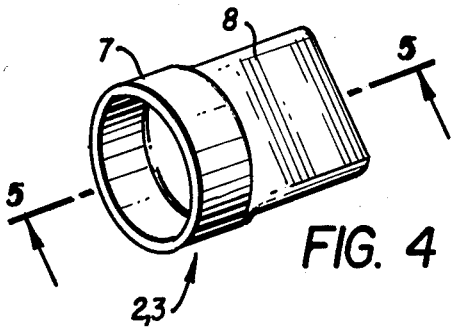
FIG. 4
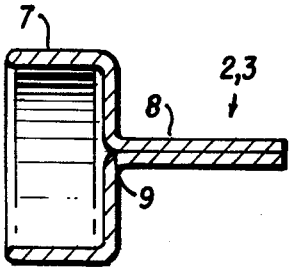
FIG. 5
FIG. 6
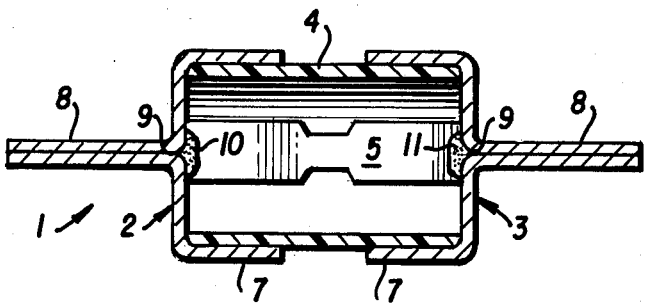
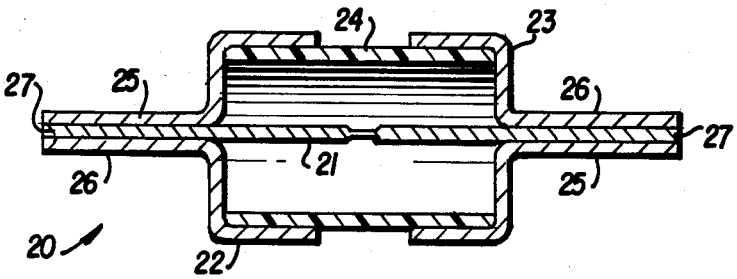
FIG. 7

CARTRIDGE FUSE CONSTRUCTION AND ASSEMBLY

This is a continuation of co-pending application Ser. No. 725,769 filed on Apr. 22, 1985, now abandoned.

BACKGROUND OF THE INVENTION

1. Field of the Invention

This invention relates to the construction and manufacture of cartridge fuses and in particular to a cartridge fuse having interally formed knife-blade ferrule terminals.

2. Description of the Prior Art

The prior art discloses a variety of cartridge fuses having knife-blade ferrule terminals. In the typical fuse of this type, a knife-blade ferrule terminal is secured to each end of a hollow tube of insulating material encasing a fusible strip connected between the ferrule terminals. The ferrule terminals, which may be of a one or two piece construction, each include a ferrule portion sized to fit over its respective end of the insulating tube, and a knife-blade terminal portion which is adapted to be secured in a conventional knife-blade fuse holder. Regardless of whether the ferrule terminal is of a one or two piece construction, when assembling fuses of this type it has generally been fairly difficult to properly align and secure the fusible strip to the ferrule terminals. For example, in fuses where the fusible strip is soldered to the ferrule terminals, the amount and distribution of the solder on the terminal can significantly affect the integrity of the bond between the fusible strip and the terminals. Too little or improperly placed solder can result in a defective electrical connection between the fusible strip and the terminals, and too much solder can result in excessive heat dissipation which adversely affects the short circuit performance of the fuse. This soldering operation is particularly difficult since it must be accomplished in a blind manner while the ferrule terminals are being assembled on the tube forming the body of the fuse. In addition to the foregoing, ferrule terminals of a two piece construction are inherently susceptable to the chance of a defective bond between the parts of the ferrule terminal as well as the usual manufacturing problems associated with insuring the concentricity of the ferrule and terminal portions of the terminal. This is of particular concern in fuses of this type since proper alignemnt of the fuse in its respective fuse holder is generally essential to obtain an adequate electrical connection between the knife-blade terminals and the fuse holder.

SUMMARY OF THE INVENTION

This invention relates to cartridge fuses and in particular to a cartridge fuse having integrally formed knife-blade ferrule terminals and a method of making the same.

The cartridge fuse includes a tubular insulating body having an opening at each of its ends, a ferrule terminal secured to each end of the insulating body, and a fusible strip supported within the body having its ends soldered or otherwise appropriately bonded to the ferrule terminals. In the preferred embodiment, each of the ferrule terminals is integrally formed from a tube of conductive material including an expanded ferrule cap portion at one end of the tube sized to fit over its respective end of the insulating body, and a flattened terminal portion at the other end of the tube forming a knife-blade terminal for the fuse. Additionally, a Vshaped notch is formed in the interior of each of the ferrule cap portions which serves to retain or contain the molten solder which ultimately bonds the fusible strip to the ferrule terminals during assembly of the fuse.

In an alternative embodiment, the terminal portion of each of the ferrule terminals is initially only partially flattened to form a passage extending through the terminal. These passages are sized to receive the ends of the fusible strip to accommodate securing the fusible strip to the ferrule terminals by inserting eeach of the ends into one of the passages and flattening the terminal portions to firmly clamp the ends of the strip within the passages. Then, to further assure the integrity of the electrical connection between the fusible strip and the ferrule terminals, molten solder is injected into the outer ends of the flattened passages.

From the foregoing, it can be seen that the invention contemplates a relatively straightforward construction which significantly simplifies assembly of the fuse while at the same time enhancing the integrity of the electrical connection between the fusible strip and the ferrule terminals of the fuse. However, it is to be understood that various changes can be made in the arrangement, form and construction of the apparatus disclosed herein without departing from the scope and spirit of the invention.

DESCRIPTION OF THE DRAWINGS

FIG. 1 is a perspective view of a cartridge fuse embodying the invention;

FIGS. 2–4 show sequential prespective views of the ferrule terminal as it is being formed;

FIG. 5 is a longitudinal cross-sectional view taken generally along line 5—5 in FIG. 4;

FIG. 6 is a longitudinal cross-sectional view taken generally along line 6—6 in FIG. 1; and FIG. 7 is a longitudinal cross-sectional view similar to FIG. 6 showing an alternative embodiment.

DESCRIPTION OF THE PREFERRED EMBODIMENT

FIGS. 1 and 6 show a cartridge fuse 1 embodying the invention having a pair of essentially identical knife-blade ferrule terminals 2 and 3 secured to the ends of a tubular insulating body 4 formed of an electrically non-conductive insulating material as is well known in the art. As in the typical cartridge fuse of this type, a fusible strip or link 5 is electrically connected between the ferrule terminals 2 and 3 which is designed to fuse or melt to break the electrical circuit through the fuse when a predetermined load or short occurs in the circuit the fuse is to be used in.

Referring to FIGS. 2–5, each of the ferrule terminals 2 and 3 is integrally formed from an electrically conductive metal tube 6. Each of the tubes is formed with an expanded cylindrical ferrule cap portion 7 at one of its ends which is sized to snuggly fit over its respective end of the insulating body 4, and a flattened terminal portion 8 at its other end which is sized to form a knife-blade terminal for the fuse. As shown in the drawings, one end of the metal tube 6 is initially flattened to form the flattened terminal portion 8 illustrated in FIG. 3, and then the other end of the tube 6 is expanded to form the cylindrical ferrule cap portion 7 illustrated in FIGS. 4 and 5. In this regard, it should be particularly noted that during the forming operation a V-shaped notch or groove 9 is formed in the base of the interior of the ferrule cap portion 7 extending along the juncture of the ferrule cap and terminal portions 7 and 8. As will be described, the V-shaped notches 9 serve to contain the molten solder used to secure the fusible strip 5 to the ferrule terminals 2 and 3 during assembly of the fuse 1.

When assembling the fuse 1, a bead of molten solder 10 dropped into the V-shaped notch 9 of the ferrule terminal 2 and one end of the fusible strip 5 is immersed in the bead 10 at the center of the ferrule terminal. Upon hardening of the solder the fusible strip 5 is firmly secured to the interior of the ferrule terminal 2. Next, this assembly is secured to the insulating body 4 by sliding the cylindrical ferrule cap portion 7 over one of the ends of the body 4, it being understood that the ferrule cap portion 7 may be glued or otherwise appropriately secured to the body as is well known in the industry. Once this is accomplished, the assembly is completed by depositing a second bead of molten solder 11 in the V-shaped notch 9 in the other ferrule terminal 3 and sliding its cylindrical ferrule cap portion 7 over the other end of the insulating body 4 in a fashion immersing the other end of the fusible strip 5 in the second bead of molten solder 11 which subsequently hardens to secure the fusible strip within the fuse to complete the assembly. As in the case of the ferrule terminal 2, the ferrule terminal 3 may be glued or otherwise suitably bonded to the end of the insulating body 4.

FIG. 7 shows a cartridge fuse 20 illustrating an alternative embodiment of the invention wherein a fusible strip or link 21 is secured between a pair of ferrule terminals 22 and 23 within a tubular insulating body 24. In this embodiment, the ends of the fusible strip 21 are each clamped within a passage 25 formed in its respective ferrule terminal.

The ferrule terminals 22 and 23 are fabricated in essentially the same fashion as the ferrule terminals 2 and 3 except that their terminal portions 26 are initially only partially flattened to form the passages 25. The passages 25, which are sized to receive the ends of the fusible strip 21, accommodate securing the fusible strip to the ferrule terminals by inserting each end of the strip into one of the passages 25 and then flattening the terminal portions 26 to firmly clamp the ends of the strip within the passages. Then, to further assure the integrity of the electrical connection between the fusible strip 21 and the ferrule terminals 22 and 23, molten solder 27 is injected into the other ends of the flattened passages 25 in V-shaped notches 28 which are formed in the ends when the terminal portions 26 are flattened.

When considering the foregoing, it should be noted that the invention contemplates two different methods of securing the fusible strip 21 within the passages 25. In the first case, the fusible strip 21 is secured in the passage 25 of the ferrule terminal 22 before it is secured to the end of the tubular insulating body 24. After this is accomplished, the ferrule terminal 22 is secured to one end of the insulating body 24 as in the first embodiment. Then, with the fusible strip 21 generally centered in the insulating body 24, the other ferrule terminal 23 is slid over the other end of the fusible strip and secured to the other end of the insulating body and firmly clamped to the strip to complete the assembly.

The other method of assembling the fuse 20 calls for initially securing both of the ferrule terminals 22 and 23 to their respective ends of the insulating body 24. Then, the fusible strip 21 is simply slid into the passage 25 and firmly secured within the fuse by flattening the terminal portions 26 and injecting molten solder 27 into the ends of the passages 25 in the V-shaped notches 28.

What is claimed is:

1. In a cartridge fuse comprising a tubular insulating body with two ends, a ferrule disposed at each end of said tubular insulating body, each ferrule having a cylindrical tubular portion with a flattened terminal portion extending therefrom and a fusible strip extending between and electrically connected to said ferrules, the improvement comprising a V-shaped notch disposed at the intersection of the cylindrical tubular portion and the flattened terminal portion of each ferrule, said fusible strip having two free ends, each of said free ends terminating at a respective V-shaped notch and a conductive bonding material disposed between V-shaped notch and the respective free end of the fusible link for electrically connecting said fusible strip to said ferrules.

2. The improvement according to claim 1, wherein said conductive bonding material is solder.

3. The improvement according to claim 1, wherein said fusible strip is a flat strip having a rectangular cross-section.

4. The improvement according to claim 3, wherein said flattened ends are disposed in a first plane and said fusible strip is disposed in a second plane orthogonal to said first plane.

* * * * *